US012631380B2

(12) United States Patent
Nishimura et al.

(10) Patent No.: US 12,631,380 B2
(45) Date of Patent: May 19, 2026

(54) FLUID LEAKAGE DETECTION SYSTEM

(71) Applicant: DAIKIN INDUSTRIES, LTD., Osaka (JP)

(72) Inventors: Tadafumi Nishimura, Osaka (JP); Tetsuya Okamoto, Osaka (JP); Manabu Yoshimi, Osaka (JP); Hiroshi Doumae, Osaka (JP); Takuya Hanada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 166 days.

(21) Appl. No.: 18/425,501

(22) Filed: Jan. 29, 2024

(65) Prior Publication Data

US 2024/0167744 A1 May 23, 2024

Related U.S. Application Data

(63) Continuation of application No. PCT/JP2022/022209, filed on May 31, 2022.

(30) Foreign Application Priority Data

Jul. 30, 2021 (JP) ..... 2021-125792

(51) Int. Cl.
*F25B 49/00* (2006.01)

(52) U.S. Cl.
CPC ..... *F25B 49/005* (2013.01); *F25B 2500/222* (2013.01)

(58) Field of Classification Search
CPC ..... F24F 11/36; F24F 2140/00; F25B 13/00; F25B 2500/222; F25B 41/40; F25B 49/005; G01M 3/18
See application file for complete search history.

(56) References Cited

U.S. PATENT DOCUMENTS

| | | | | |
|---|---|---|---|---|
| 2018/0109331 | A1* | 4/2018 | Nikitin | G01R 29/10 |
| 2021/0021327 | A1* | 1/2021 | Jorguseski | H04W 72/12 |
| 2023/0006479 | A1* | 1/2023 | Murai | H02J 50/23 |

FOREIGN PATENT DOCUMENTS

| | | | |
|---|---|---|---|
| JP | 2016-23910 | A | 2/2016 |
| JP | 2016-201888 | A | 12/2016 |
| JP | 2018-151135 | A | 9/2018 |
| JP | 2019-138591 | A | 8/2019 |
| JP | 2020-173502 | A | 10/2020 |
| JP | 2020-204432 | A | 12/2020 |
| WO | 2009/054353 | A1 | 4/2009 |

(Continued)

OTHER PUBLICATIONS

European Search Report of corresponding EP Application No. 22 84 9023.1 dated Aug. 16, 2024.

(Continued)

*Primary Examiner* — Henry T Crenshaw
(74) *Attorney, Agent, or Firm* — Spencer Fane LLP

(57) ABSTRACT

A fluid leakage detection system includes a detection device, a communication device, and a power supply unit. The detection device includes a detector that detects a leakage of a fluid from a flow path. The communication device includes a communicator to transmit and receive, to and from the detection device, predetermined information as to whether there is a leakage of the fluid. The power supply unit supplies power to the detection device in a wireless manner.

14 Claims, 8 Drawing Sheets

(56) References Cited

FOREIGN PATENT DOCUMENTS

| | | | | |
|---|---|---|---|---|
| WO | 2020204432 | | * | 12/2020 |
| WO | 2021/138268 | A1 | | 7/2021 |
| WO | WO 2012138268 | | * | 7/2021 |

OTHER PUBLICATIONS

International Preliminary Report of corresponding PCT Application No. PCT/JP2022/022209 dated Feb. 8, 2024.
International Search Report of corresponding PCT Application No. PCT/JP2022/022209 dated Aug. 9, 2022.

* cited by examiner

FLUID LEAKAGE DETECTION SYSTEM

CROSS-REFERENCE TO RELATED APPLICATIONS

This is a continuation of International Application No. PCT/JP2022/022209 filed on May 31, 2022, which claims priority to Japanese Patent Application No. 2021-125792, filed on Jul. 30, 2021. The entire disclosures of these applications are incorporated by reference herein.

BACKGROUND

Technical Field

The present disclosure relates to a fluid leakage detection system.

Background Art

WO2009/054353 describes a method of detecting a leakage of a refrigerant from a refrigerant pipe, using an impedance measuring device. In this detection method, electrodes are attached to target points of the refrigerant pipe, and the impedance at the electrodes are measured. A leakage of the refrigerant can be detected at a point at which the measured impedance value has changed.

SUMMARY

A first aspect of the present disclose is directed to a fluid leakage detection system including a detection device, a communication device, and a power supply unit. The detection device includes a detector configured to detect a leakage of a fluid from a flow path. The communication device includes a communicator configured to transmit and receive, to and from the detection device, predetermined information as to whether there is a leakage of the fluid. The power supply unit is configured to supply power to the detection device in a wireless manner.

DETAILED DESCRIPTION OF EMBODIMENT(S)

An embodiment of the present disclosure will be described with reference to the drawings. The following embodiments are merely exemplary ones in nature, and are not intended to limit the scope, application, or use of the present invention. Features of the embodiments, variations, and other examples described below can be combined or partially substituted within the range where the present invention can be embodied.

EMBODIMENT

Figure 1:
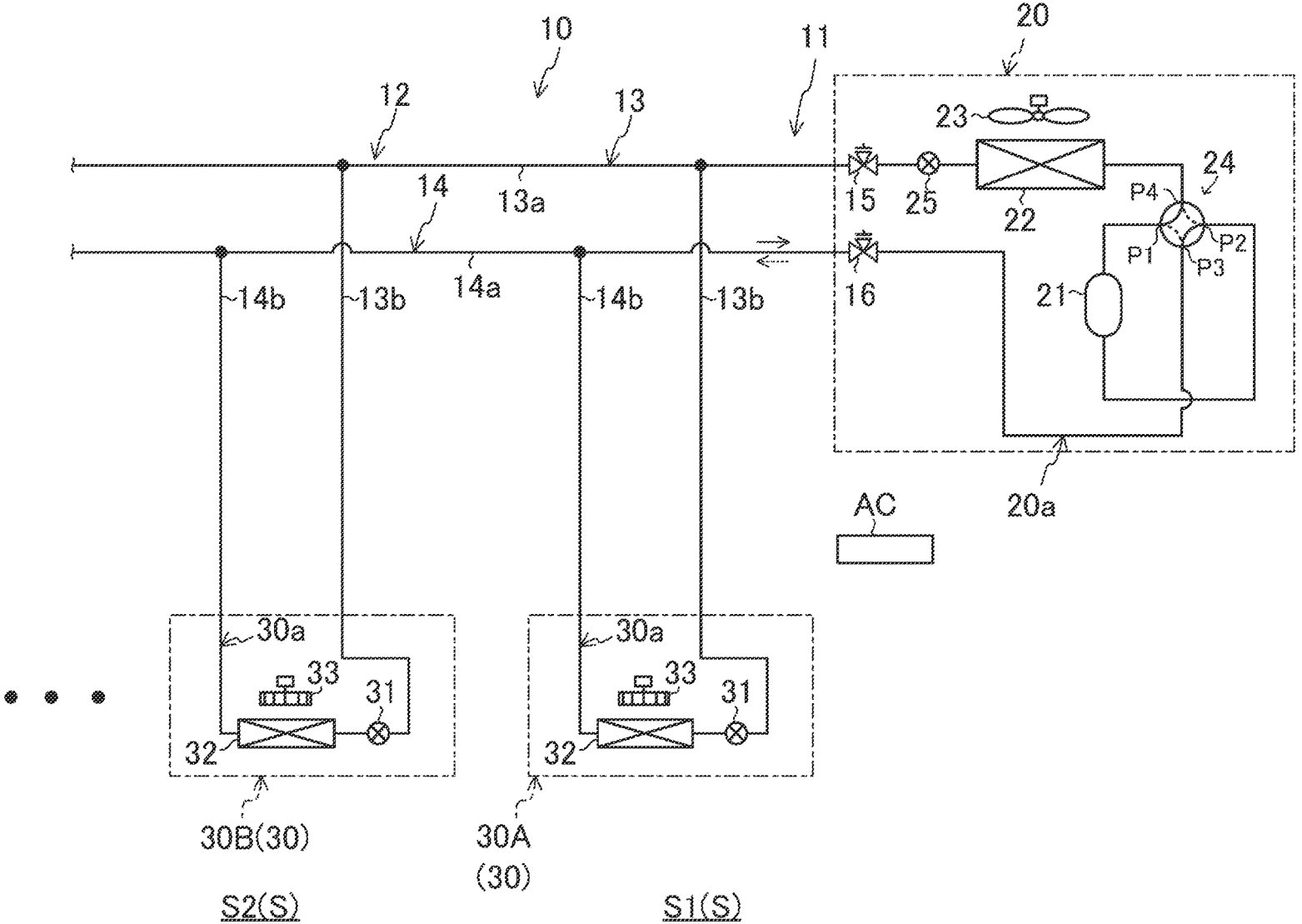
FIG. 1 is a piping system diagram of an air conditioner to which a fluid leakage detection system according to an embodiment is applied.

As shown in FIG. 1, a fluid leakage detection system (1) according to an embodiment is applied to an air conditioner (10). The air conditioner (10) according to this example will be described below.

(1) General Configuration of Air Conditioner

The air conditioner (10) adjusts the temperature of air in a target space (S) to be air-conditioned. The target space (S) according to this example is an indoor space, such as a building. The air conditioner (10) cools and heats the target space (S). The air conditioner (10) is a multiple type including a plurality of utilization units (30). The air conditioner (10) includes a heat source unit (20), the plurality of utilization units (30), a refrigerant pipe (12), and an air conditioning controller (AC). The plurality of utilization units (30) and the heat source unit (20) are connected to each other via the refrigerant pipe (12). This connection forms a refrigerant circuit (11) which is a closed circuit.

(2-1) Refrigerant Circuit

The refrigerant circuit (11) includes a heat source circuit (20*a*) in the heat source unit (20), and a utilization circuit (30*a*) in each utilization unit (30). The refrigerant circuit (11) is filled with a refrigerant. The refrigerant in this example is difluoromethane, for example.

(2-2) Refrigerant Pipe

The refrigerant pipe (12) includes a liquid connection pipe (13) and a gas connection pipe (14). The refrigerant pipe (12) is placed in a space behind a ceiling or a space behind a wall. The refrigerant pipe (12) corresponds to a flow path (12) according to the present disclosure. A fluid mixture of a refrigerant and a refrigerating machine oil flows through the refrigerant pipe (12). This fluid mixture corresponds to a fluid according to the present disclosure.

The liquid connection pipe (13) includes a first main pipe (13*a*) and a plurality of first branch pipes (13*b*) branching from the first main pipe (13*a*). One end of the first main pipe (13*a*) is connected to the heat source circuit (20*a*) via a first shut-off valve (15) which is a liquid shut-off valve. One end of each of the plurality of first branch pipes (13*b*) is connected to the first main pipe (13*a*). The other end of each of the plurality of first branch pipes (13*b*) is connected to the corresponding utilization circuit (30*a*).

The gas connection pipe (14) includes a second main pipe (14*a*) and a plurality of second branch pipes (14*b*) branching from the second main pipe (14*a*). One end of the second main pipe (14*a*) is connected to the heat source unit (20) via a second shut-off valve (16) which is a gas shut-off valve. One end of each of the plurality of second branch pipes (14*b*) is connected to the second main pipe (14*a*). The other end of each of the plurality of second branch pipes (14*b*) is connected to the corresponding utilization unit (30).

(2-3) Heat Source Unit

The heat source unit (20) is an outdoor unit placed outdoors. The heat source unit (20) is placed on the roof of a building or the like or on the ground, for example.

The heat source unit (20) includes a compressor (21), a heat source heat exchanger (22), a heat source fan (23), a four-way switching valve (24), and a heat source expansion valve (25).

The compressor (21) compresses the sucked refrigerant. The compressor (21) discharges the compressed refrigerant. The compressor (21) stores therein the refrigerating machine oil. Part of the refrigerating machine oil flows through the refrigerant pipe (12), together with the refrigerant. In other words, the fluid mixture of the refrigerant and the refrigerating machine oil flows through the refrigerant pipe (12).

The heat source fan (23) transfers the air passing through the heat source heat exchanger (22). The heat source heat exchanger (22) allows heat exchange between refrigerant flowing therein and outdoor air.

The four-way switching valve (24) changes the flow path in the refrigerant circuit (11) so as to switch between a first refrigeration cycle that is a cooling cycle and a second refrigeration cycle that is a heating cycle. The four-way switching valve (24) has a first port (P1), a second port (P2), a third port (P3), and a fourth port (P4). The first port (P1) is connected to a discharge portion of the compressor (21). The second port (P2) is connected to a suction portion of the compressor (21). The third port (P3) is connected to the gas connection pipe (14) via the second shut-off valve (16). The fourth port (P4) is connected to a gas end of the heat source heat exchanger (22).

The heat source expansion valve (25) decompresses refrigerant. The heat source expansion valve (25) is arranged between the first shut-off valve (15) and the heat source heat exchanger (22) in the heat source circuit (20*a*). The heat source expansion valve (25) is an electronic expansion valve whose opening degree is adjustable.

(2-4) Utilization Unit

The plurality of utilization units (30) according to this example include a first utilization unit (30A) and a second utilization unit (30B). The number of the utilization units (30) may be three or more. The configurations of the first utilization unit (30A) and the second utilization unit (30B) are basically the same. Hereinafter, the first utilization unit (30A) and the second utilization unit (30B) may be simply referred to as the utilization units (30) for the sake of simplicity.

Each utilization unit (30) is an indoor unit placed indoors, for example, in a building. The utilization unit (30) includes a utilization expansion valve (31), a utilization heat exchanger (32), and a utilization fan (33).

The utilization expansion valve (31) decompresses the refrigerant. The utilization expansion valve (31) is arranged in the liquid-side flow path of the utilization heat exchanger (32) in the utilization circuit (30*a*). The utilization expansion valve (31) is an electronic expansion valve whose opening degree is adjustable.

The utilization fan (33) transfers the air passing through the utilization heat exchanger (32). The utilization heat exchanger (32) allows heat exchange between the refrigerant flowing therein and indoor air.

(2-5) Air Conditioning Controller

The air conditioner (10) includes an air conditioning controller (AC). The air conditioning controller (AC) includes a micro controller unit (MCU), an electric circuit, and an electronic circuit. The MCU includes a central processing unit (CPU), a memory, and a communication interface. The memory stores various programs to be executed by the CPU. The air conditioning controller (AC) controls the refrigerant circuit (11).

(3) Fluid Leakage Detection System

The fluid leakage detection system (1) according to this example will be described. The fluid leakage detection system (1) according to this example includes a plurality of detection devices (40) and a reading device (50).

(3-1) Detection Device

Each detection device (40) detects a leakage of the refrigerant from the refrigerant pipe (12). The plurality of detection devices (40) are arranged in the refrigerant pipe (12) of the refrigerant circuit (11) according to this example. The plurality of detection devices (40) include a first detection device (40*a*) and a second detection device (40*b*). The first detection device (40*a*) corresponds to a first detection device (40*a*) according to the present disclosure. The second detection device (40*b*) corresponds to a second detection device (40*b*) according to the present disclosure.

Each of the plurality of detection devices (40) is arranged at a point where a leakage of the refrigerant may occur, such as a connecting point or a brazing point of the refrigerant pipes (12). For example, the detection devices (40) are arranged at points of the refrigerant pipe (12) near the first shut-off valve (15) and the second shut-off valve (16), the branch points where the first main pipe (13*a*) branches into the first branch pipes (13*b*), or the branch points where the second main pipe (14*a*) branches into the second branch pipes (14*b*).

Each detection device (40) transmits and receives predetermined information to and from the reading device (50). Power is supplied to the detection device (40) from the reading device (50) in a wireless manner. The detection device (40) will be described below. The plurality of detection devices (40) including the first detection device (40*a*) and the second detection device (40*b*) are identical. In the following description, the detection devices (40) including the first detection device (40*a*) and the second detection device (40*b*) may be simply referred to as "detection devices."

Figure 2:
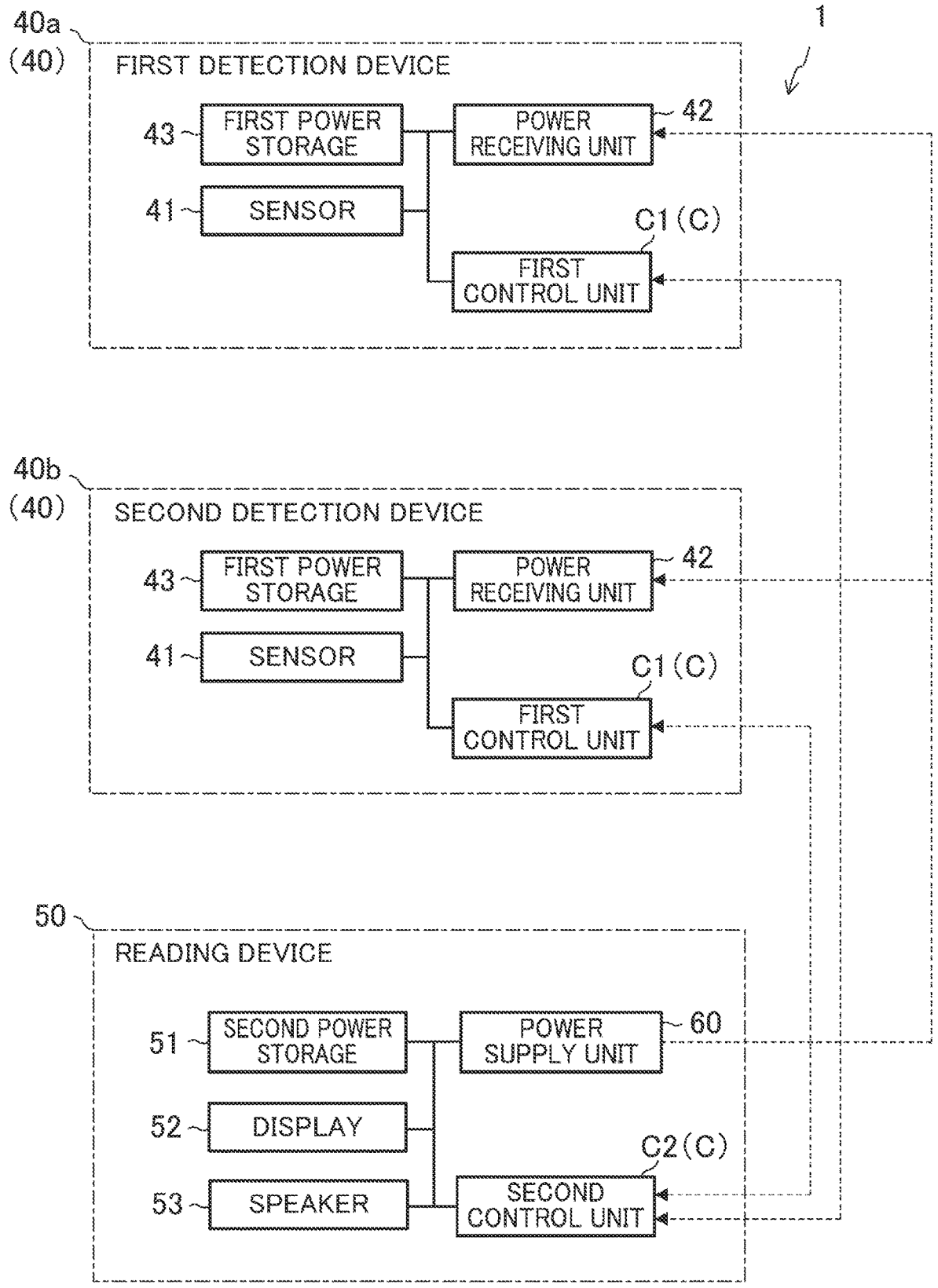
FIG. 2 is a block diagram showing a configuration of the fluid leakage detection system according to the embodiment.

As shown in FIG. 2, each detection device (40) includes a sensor (41), a power receiving unit (42), a first power storage (43), and a first control unit (C1).

The sensor (41) is a capacitive sensor. The sensor (41) has detection electrodes. The sensor (41) detects the refrigerating machine oil mixed in the refrigerant, using the detection electrode. Specifically, if the refrigerating machine oil enters the detection area of the sensor (41), the capacitance value changes in accordance with a change in the electric charge of the detection electrode. This change in the capacitance value allows detection of a leakage of the fluid mixture of the refrigerant and the refrigerating machine oil from the refrigerant pipe (12). In the following description, the fluid mixture of the refrigerant and the refrigerating machine oil may be simply referred to as a "refrigerant."

The power receiving unit (42) includes a power receiving circuit. The power receiving circuit includes a power receiving antenna. The power receiving antenna receives power supply radio waves transmitted from a power supply unit (60) which will be described later. The power receiving circuit transmits the power received by the power receiving antenna to the first power storage (43).

The first power storage (43) stores the power supplied from the power supply unit (60). Specifically, the first power storage (43) stores the power transmitted from the power receiving circuit. The first power storage (43) supplies the stored power to various devices of the detection device (40) including the sensor (41).

The first control unit (C1) is connected to the sensor (41), the power receiving unit (42), and the first power storage (43) via communication lines. The first control unit (C1) controls the sensor (41), the power receiving unit (42), and the first power storage (43). The first control unit (C1) executes the refrigerant leakage detection operation using the sensor (41), only when the first power storage (43) is supplying power. The first control unit (C1) will be described in detail later.

(3-2) Reading Device

The reading device (50) supplies power to the detection devices (40) in a wireless manner. The reading device (50) is of a portable type that can be carried in a hand of the user. The reading device (50) transmits and receives predetermined information to and from the detection devices (40) present in a predetermined area from the reading device (50). The reading device (50) corresponds to a communication device (50) according to the present disclosure.

Figure 3:
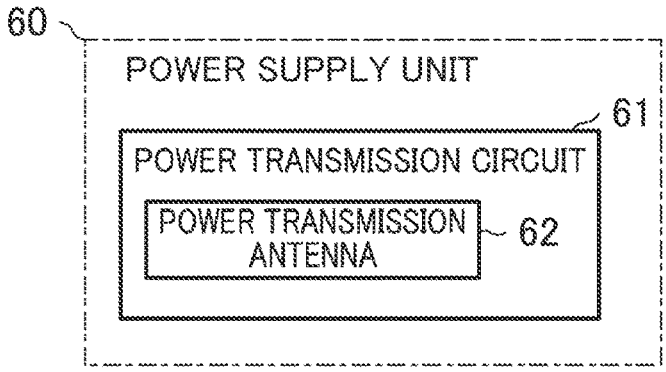
FIG. 3 is a schematic view showing a configuration of a power supply unit of the fluid leakage detection system according to the embodiment.
Figure 4:
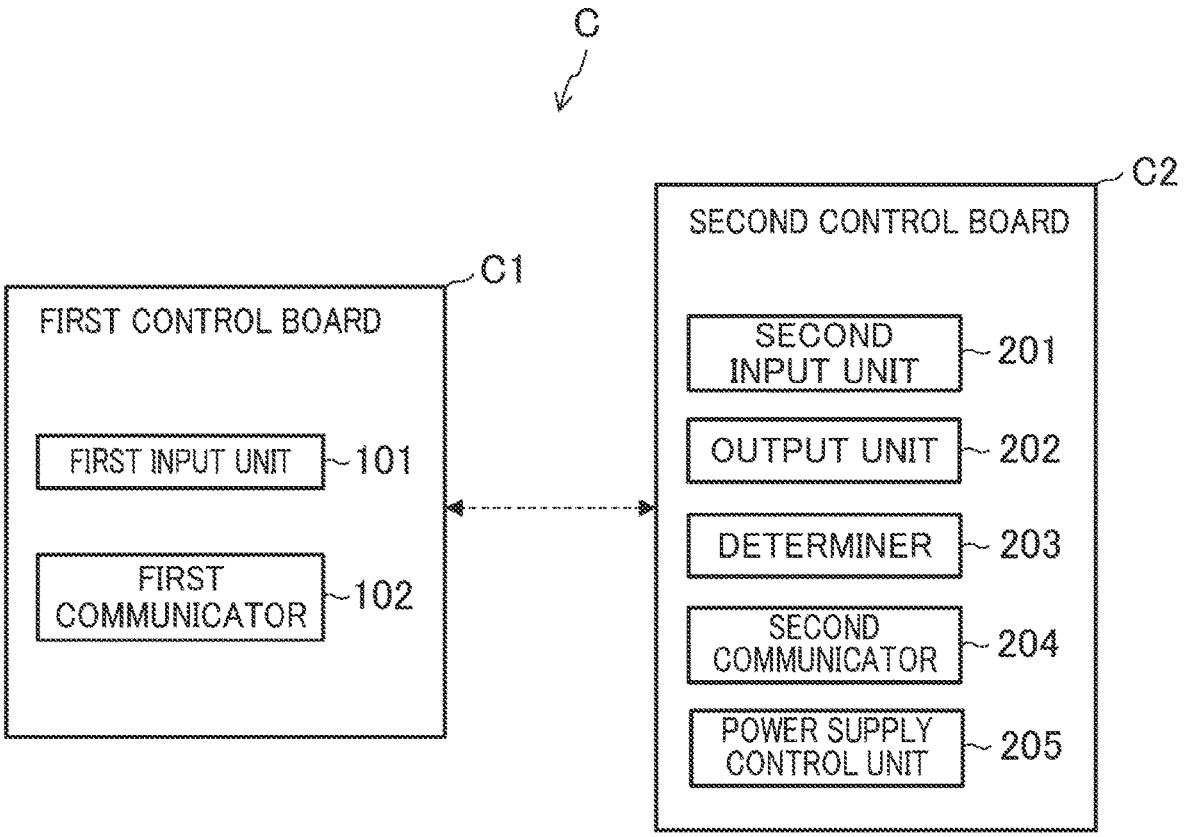
FIG. 4 is a block diagram showing a configuration of a control device of the fluid leakage detection system according to the embodiment.

As shown in FIGS. 2 and 3, the reading device (50) includes a second power storage (51), the power supply unit (60), a display (52), a speaker (53), and a second control unit (C2).

The second power storage (51) stores power supplied from the power supply unit (60). The second power storage (51) is charged by being connected to an external power source.

The power supply unit (60) supplies power to the detection devices (40) in a wireless manner. Specifically, the power supply unit (60) has a power transmission circuit (61). The power transmission circuit (61) includes a power transmission antenna (62). The radio waves generated by the power transmission circuit (61) are output to the power transmission antenna (62) after the intensity and frequency of the radio waves are adjusted.

The power transmission antenna (62) corresponds to a power transmission member (62) according to the present disclosure. The power transmission antenna (62) transmits power supply radio waves to the detection devices (40). The power transmission antenna (62) is an array antenna, for example. The directivity of the power transmission antenna (62) is controlled so that the intensity of the power to be received by a specific detection device (40) increases selectively. Specifically, the power supply unit (60) controls the intensity of the radio waves emitted in a predetermined direction from the power transmission antenna (62). This leads to selective power supply to the detection device (40) located in this direction.

For example, it is assumed that the first detection device (40*a*) and the second detection device (40*b*) are located in the refrigerant pipe (12) in a space behind a ceiling. The power transmission antenna (62) is assumed to have the directivity according to which the radio waves going directly above the reading device (50) has the higher intensity. In this case, the reading device (50) is moved to a point directly below the first detection device (40*a*), whereby the power transmission antenna (62) transmits the power supply radio waves whose directivity is controlled so that the intensity of the power to be received by the first detection device (40*a*) is higher than the intensity of the power to be received by the second detection device (40*b*). This allows for preferential power supply to the specific detection device (40) by the power transmission antenna (62).

The power supply unit (60) according to this example supplies the power when the distance between the power transmission antenna (62) and the detection device (40) is within 5 m. In other words, each of the detection devices (40) according to this example can receive the power within a distance of 5 m from the power transmission antenna (62).

The display (52) corresponds to an annunciator (52) according to the present disclosure. The display (52) displays the information received from the detection devices (40). For example, based on the information received from each detection device (40), the display (52) displays the fact that the detection device (40) detected a leakage of the refrigerant or the detection device (40) detected no leakage of the refrigerant.

The speaker (53) corresponds to an annunciator (53) according to the present disclosure. The speaker (53) emits a sound indicating that the refrigerant has been detected or a sound indicating that no refrigerant has been detected, based on the information received from each detection device (40).

The second control unit (C2) is connected to the second power storage (51), the power supply unit (60), the display (52), and the speaker (53) via communication lines. The second control unit (C2) controls the second power storage (51), the power supply unit (60), the display (52), and the speaker (53). The details of the second control unit (C2) will be described later.

(3-3) Control Device

The fluid leakage detection system (1) includes a control device (C). The control device (C) includes the first control unit (C1) and the second control unit (C2). Each control units (C1, C2) includes a control board. The control board includes a micro controller unit (MCU), an electric circuit, and an electronic circuit. The first control unit (C1) and the second control unit (C2) are connected to each other by a wireless communication line.

First Control Unit

The first control unit (C1) is connected to the sensor (41), the first power storage (43), and the power receiving unit (42) in the detection device (40) in a wired or wireless manner. The first control unit (C1) includes a first input unit (101) and a first communicator (102).

The first input unit (101) receives a signal indicating the capacitance value output from the sensor (41). The first input unit (101) receives information indicating that power is being supplied to the first power storage (43) from the power supply unit (60) via the power receiving unit (42).

The first communicator (102) transmits, to the reading device (50), information indicating the capacitance value input to the first input unit (101). The information indicating the capacitance value is the information indicating the first information or the second information. The first information is the information indicating that a leakage of the refrigerant has been detected. The "information indicating that a leakage of the refrigerant has been detected" is the information indicating, for example, that the capacitance value detected by the sensor (41) has exceeded a predetermined threshold. The second information is the information indicating that no leakage of the refrigerant has been detected. The "information indicating that no leakage of the refrigerant has been detected" is the information indicating, for example, that the capacitance value detected by the sensor (41) is within the predetermined threshold. The first communicator (102) transmits, to the reading device (50), information indicating that power is being supplied to the first power storage (43).

Second Control Unit

The second control unit (C2) is connected to the power supply unit (60), the second power storage (51), the display (52), and the speaker (53) in a wireless or wired manner. The second control unit (C2) includes a second input unit (201), an output unit (202), a determiner (203), a second communicator (204), and a power supply control unit (205).

The second communicator (204) transmits and receives predetermined information to and from the detection devices (40). For example, the second communicator (204) transmits, to the detection devices (40), commands to start the refrigerant leakage detection operation by the sensor (41). The second communicator (204) transmits and receives predetermined information on a leakage of the refrigerant to and from each detection device (40). Specifically, the second communicator (204) receives the above described first and second information transmitted from the detection device (40). The second communicator (204) receives information indicating that power is being supplied to the detection device (40). The second communicator (204) corresponds to a communicator (204) according to the present disclosure.

The second input unit (201) receives predetermined information including the first information and the second information received by the second communicator (204).

The output unit (202) outputs, to the display (52) and the speaker (53), signals corresponding to the first information and the second information input to the second input unit (201).

The determiner (203) determines whether there is a leakage of the refrigerant, based on the information on the capacitance value input to the second input unit (201). Specifically, the determiner (203) determines whether the information indicating the capacitance value input to the second input unit (201) indicates the first information or the second information.

The determiner (203) determines whether or not power can be supplied to the detection devices (40). Specifically, the determiner (203) determines that power can be supplied (is being supplied) to the detection device (40) when a signal indicating that power is being supplied is received from the detection device (40).

The power supply control unit (205) controls the start and end of the power supply to each detection device (40), and controls the intensity and frequency of the radio waves transmitted from the power transmission antenna (62).

Power Supply Operation and Communication Operation

Figure 5:
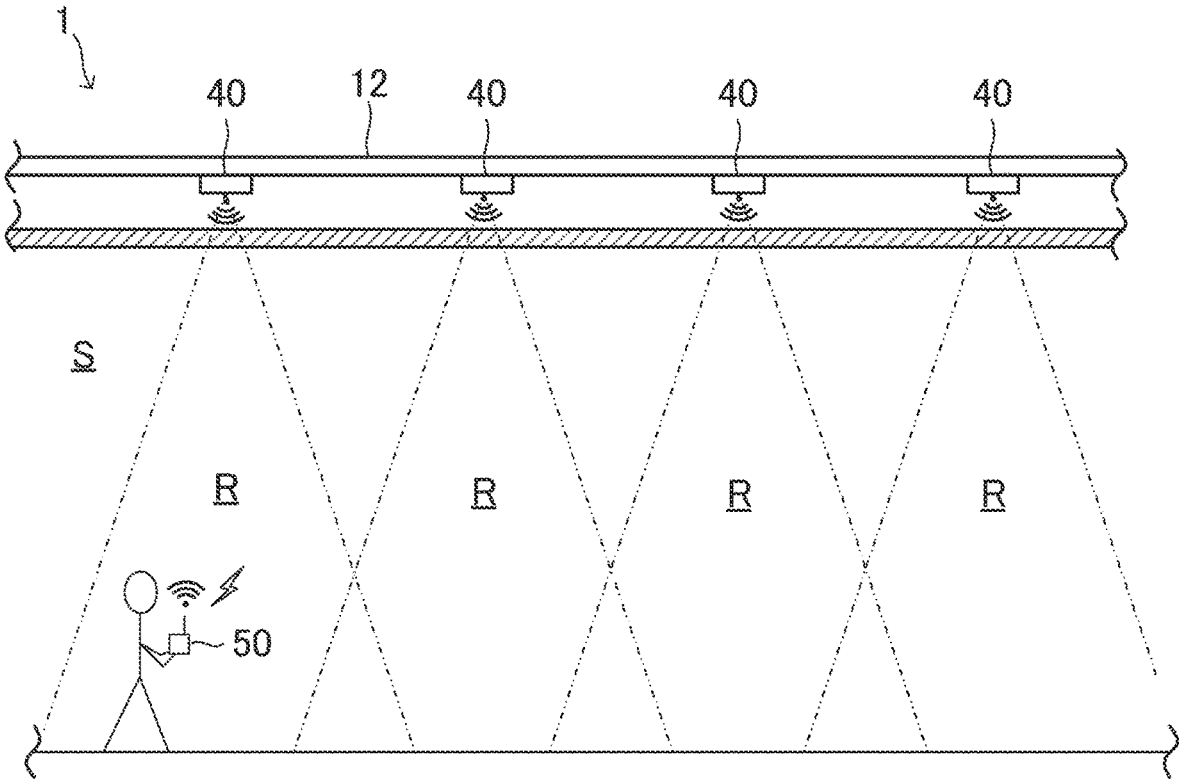
FIG. 5 is a diagram illustrating a method of checking a leakage of a refrigerant from a refrigerant pipe in the fluid leakage detection system according to the embodiment.

As shown in FIG. 5, in the fluid leakage detection system (1) according to this example, the user moves in the indoor space (S) along the refrigerant pipe (12) arranged in a space behind the ceiling, while holding the reading device (50). Accordingly, power is supplied sequentially to the plurality of detection devices (40) arranged in the refrigerant pipe (12), and whether there is a leakage of the refrigerant is checked at each point through communication with the detection devices (40). In FIG. 5, each of the communication areas (R), where it is possible to communicate with the respective detection devices (40), is an area surrounded by two dot-dot-dash lines extending radially from the detection device (40) toward the indoor space (S). In this figure, an operator standing on the floor supplies power to the detection devices (40) and communicates with the detection devices (40), with the reading device (50) held in their hands. However, the reading device (50) may be held close to the ceiling in order to reduce the chances of power supply and communication to and with a plurality of detection devices (40) at once if the distance between adjacent detection devices (40) is short.

Figure 6:
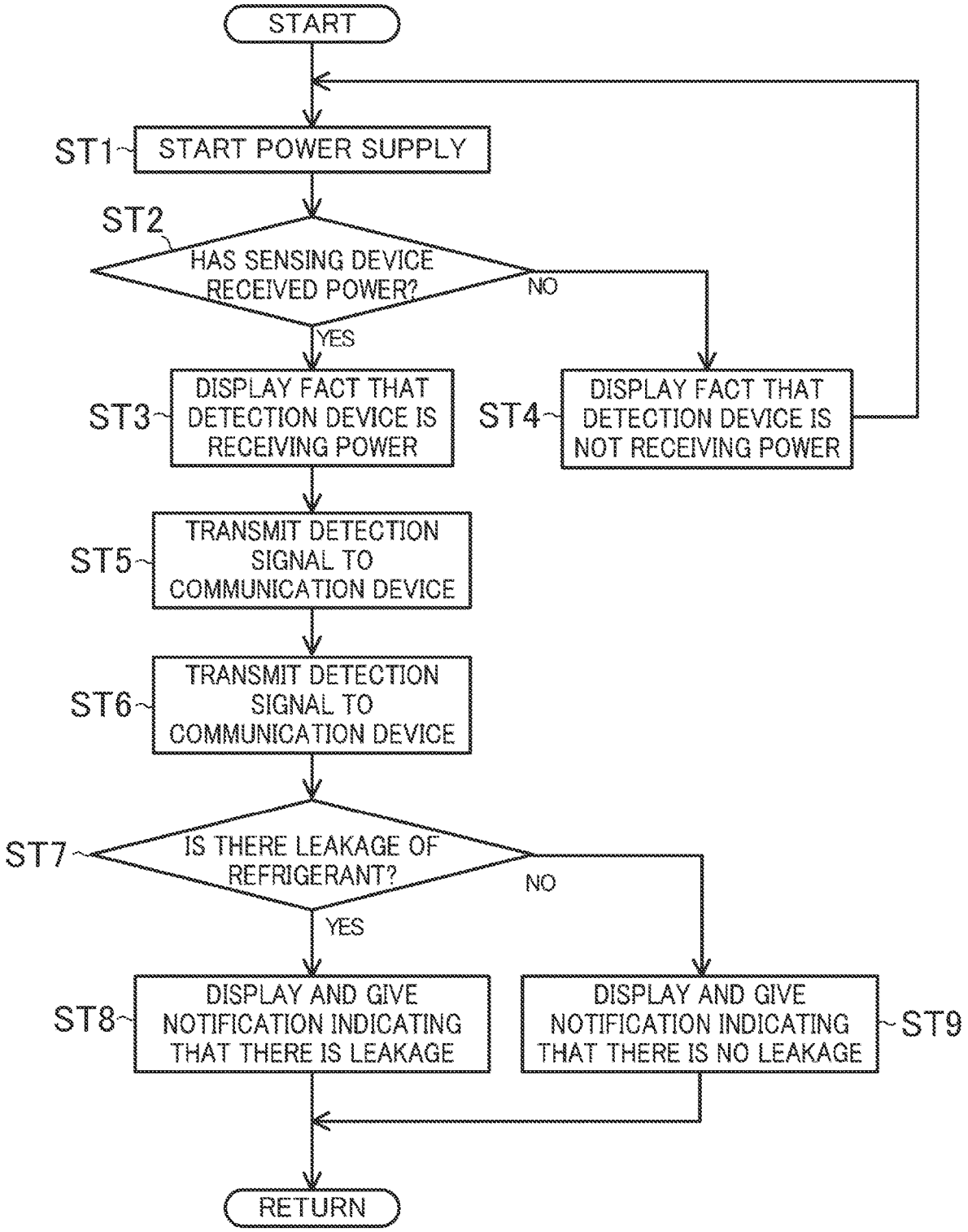
FIG. 6 is a flowchart showing control of communication and power supply between a detection device and a reading device in the fluid leakage detection system according to the embodiment.

Now, a power supply operation to the detection devices (40) and a communication operation with the detection devices (40) by the fluid leakage detection system (1) according to this example will be described with reference to FIG. 6. In the following description, the control of power supply and communication to and with one of the plurality of detection devices (40) arranged in the refrigerant pipe (12) will be described.

In Step ST1, the control device (C) starts transmitting the power supply radio waves from the reading device (50) to the detection device (40*a*), based on the operation by a user.

In Step ST2, the control device (C) determines whether the detection device (40*a*) has received power. If the detection device (40*a*) is determined to have received power (YES in Step ST2), Step ST3 is executed. If the detection device (40*a*) is determined to have received no power (NO in Step ST2), Step ST4 is executed.

In Step ST3, the control device (C) causes the display (52) to display the fact that the detection device (40*a*) is receiving power.

In Step ST4, the control device (C) causes the display (52) to display the fact that the detection device (40*a*) is not receiving power. During this moment, the user moves in the indoor space, while holding the reading device (50). After that, Step ST1 is executed again by the operation by the user.

In Step ST5, the control device (C) causes the detection device (40) to start the refrigerant leakage detection operation.

In Step ST7, the control device (C) causes the detection device (40) to transmit, to the reading device (50), information indicating the capacitance value.

In Step ST8, the control device (C) determines whether there is a leakage of the refrigerant, based on the information received in Step ST6. If the control device (C) determines that the information is the first information, in other words, if the control device (C) determines that there is a leakage of the refrigerant (YES in Step ST7), Step ST8 is executed. If the control device (C) determines that the information is the second information, in other words, if the control device (C) determines that there is no leakage of the refrigerant (NO in the step ST7), Step ST9 is executed.

In Step ST8, the control device (C) causes the display (52) to display the fact that the refrigerant is leaking, based on the first information, and causes the speaker (53) to emit a notification sound.

In Step ST9, the control device (C) causes the display (52) to display the fact that no leakage of the refrigerant has been detected, based on the second information, and causes the speaker (53) to emit a notification sound.

Attachment of Detection Device

How to attach the detection devices (40) will be described below with reference to FIGS. 7 to 9.

Figure 7:
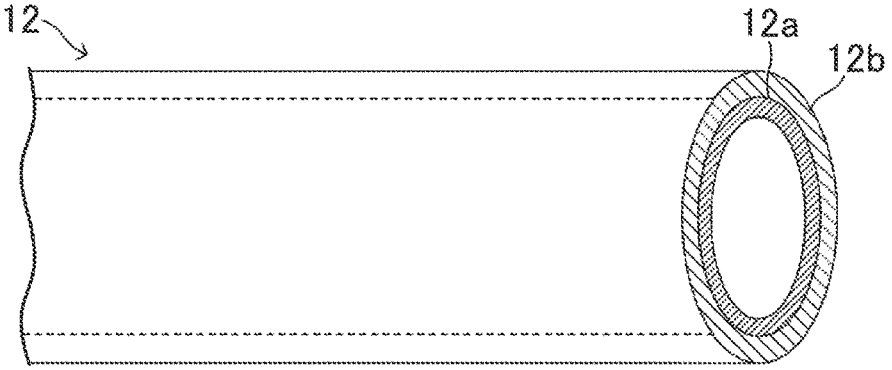
FIG. 7 is a schematic view of a refrigerant pipe to which the fluid leakage detection system according to the embodiment is applied.

As shown in FIG. 7, the refrigerant pipe (12) includes a pipe (12*a*) and a cover member (12*b*). The cover member (12*b*) covers the entire outer circumferential surface of the pipe (12*a*). The cover member (12*b*) is a heat insulating material, for example.

Figure 8:
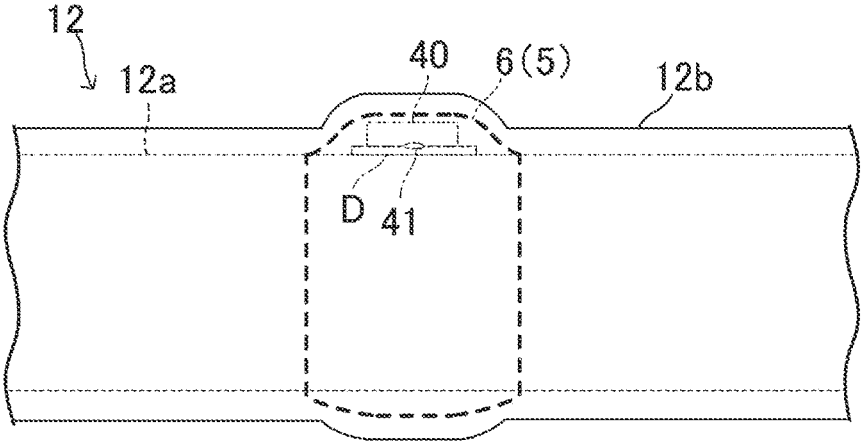
FIG. 8 is a schematic view illustrating a state in which the detection device of the fluid leakage detection system according to the embodiment is placed in a refrigerant pipe.

As shown in FIG. 8, each detection device (40) is placed between the pipe (12*a*) and the cover member (12*b*). Specifically, the detection device (40) is placed on the outer circumferential surface of the pipe (12*a*) via a first member (D) in the form of a cloth. The first member (D) includes a material that absorbs the refrigerating machine oil in the fluid mixture. The detection device (40) is placed such that the sensor (41) is in contact with the first member (D). In this manner, the sensor (41) detects the refrigerating machine oil that has oozed out to the first member (D) due to a leakage from the pipe (12*a*).

The fluid leakage detection system (1) has a sealing structure (5) (bold dashed line in FIG. 8). The sealing structure (5) has a structure that seals the sensor (41) from the outside air in the state in which the detection device (40) is attached to the pipe (12*a*). Specifically, the sealing structure (5) has a sealing member (6). The sealing member (6) is made of silicon, for example. The sealing member (6) comes into intimate contact with the outer circumferential surface of the pipe (12*a*) so as to cover the detection devices (40). More specifically, the sealing member (6) covers, of the surfaces of the casing of the detection device (40), the entire surfaces which face the outside of the pipe (12*a*).

Figure 9A:
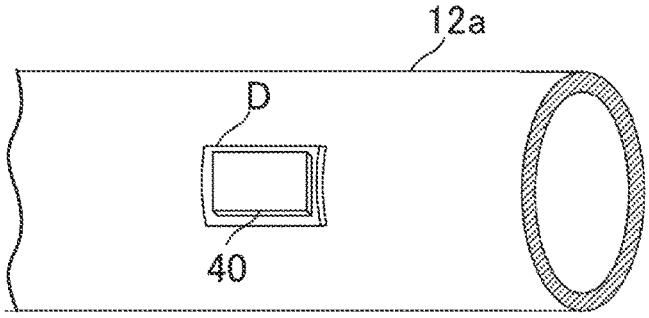
FIG. 9A is a diagram illustrating attachment of the detection device of the fluid leakage detection system according to the embodiment to the refrigerant pipe.
Figure 9B:
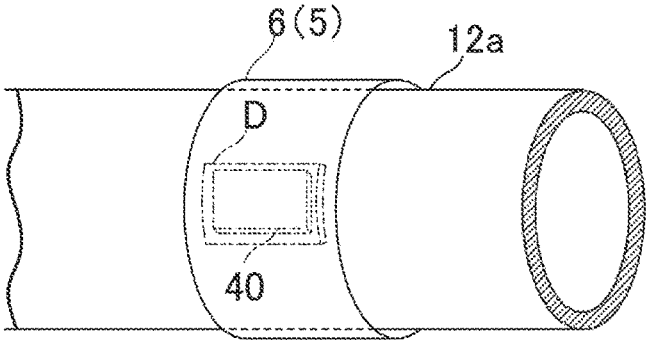
FIG. 9B is a diagram illustrating attachment of a sealing member of the fluid leakage detection system according to the embodiment to the refrigerant pipe.

How to attach each detection device (40) to the refrigerant pipe (12) will be described with reference to FIGS. 9A and 9B. The first member (D) is placed on the outer circumferential surface of the pipe (12*a*) at a predetermined point of the refrigerant pipe (12). The detection device (40) is placed on the first member (D) arranged on the pipe (12*a*) so that the sensor (41) is in contact with the first member (D) (see FIG. 9A). Next, silicon is provided thereon to cover the detection device (40) and the first member (D). The silicon is provided such that the silicon is in contact with the outer circumferential surface of the pipe (12*a*) around the detection device (40) to seal the sensor (41) of the detection device (40) from the outside. In this example, the silicon extends along the circumference of the pipe (12*a*). The sealing structure is formed in this manner. Next, the cover member (12*b*) is attached to the pipe (12*a*) over the silicon.

Advantages of Embodiment

A fluid leakage detection system (1) according to the embodiment includes: a detection device (40) including a detector (41) configured to detect a leakage of a fluid mixture (fluid) containing a refrigerant and a refrigerating machine oil from a refrigerant pipe (12) (flow path); a reading device (50) including a communicator (204) configured to transmit and receive, to and from the detection device (40), predetermined information as to whether there is a leakage of the fluid mixture; and a power supply unit (60) configured to supply power to the detection device (40) in a wireless manner.

Accordingly, the detection device (40) is supplied with power in a wireless manner and thus requires no power supply line to be connected to the detection device (40). As a result, even if a plurality of detection devices (40) are provided, there is no need to lay power supply lines for the detection devices (40). It is therefore possible to place the detection device (40) easily and increase the flexibility in placement of the detection device (40).

In the fluid leakage detection system (1) according to the embodiment, the refrigerant pipe (12) includes: a pipe (12*a*); and a cover member (12*b*) that covers an outer circumferential surface of the pipe (12*a*), and the detection device (40) is arranged between the pipe (12*a*) and the cover member (12*b*).

For example, if a power supply line is connected to a detection device (40), the power supply line needs to be placed between the cover member (12*b*) and the pipe (12*a*), which may result in complicated laying works. On the other hand, the detection device (40) according to the present disclosure is wireless and does not require such laying works.

A fluid leakage detection system (1) according to the embodiment further includes a sealing structure (5) configured to seal the detector (41) from outside air in a state in which the detection device (40) is attached to the pipe (12*a*).

Accordingly, the sensor (41) is sealed from the outside air, which can reduce the influence of condensation or other phenomena on the outer surface of the pipe (12*a*). As a result, the sensitivity of detecting a leakage of the refrigerant improves.

In the fluid leakage detection system (1) according to the embodiment, the sealing structure (5) includes a sealing member (6) that comes into intimate contact with the outer circumferential surface of the pipe (12*a*) so as to cover the detection device (40). The sealing member (6) can form the sealing structure (5) covering the entire detection device (40). If the sealing member (6) is made of silicon, the sealing structure can be easily formed by simply spraying the silicon onto the detection device (40).

The fluid leakage detection system (1) according to the embodiment includes a first detection device (40*a*) and a second detection device (40*b*). The first detection device (40*a*) and the second detection device (40*b*) are arranged at different points of the refrigerant pipe (12).

Accordingly, a leakage of the refrigerant can be detected at the plurality of points, which makes it possible to identify which point in the refrigerant pipe (12) the leakage of the refrigerant occurs.

In the fluid leakage detection system (1) according to the embodiment, the power supply unit (60) is provided in the reading device (50) (communication device). The reading device (50) includes the power transmission member (62) configured to transmit a power supply radio wave to the detection device (40).

Accordingly, the reading device (50) can supply power to the detection device (40) and communicate with the detection device (40). Since the single reading device (50) is capable of the power supply and the communication, the power supply operation and the communication operation can be performed relatively easily.

In the fluid leakage detection system (1) according to the embodiment, the power transmission antenna (62) transmits the power supply radio wave whose directivity is controlled so that an intensity of power to be received by the first detection device (40*a*) is higher than an intensity of power to be received by the second detection device (40*b*). This allows for preferential wireless power supply to the specific detection device (40).

In the fluid leakage detection system (1) according to the embodiment, the detection device (40) receives the power within a distance of 5 m from the power transmission antenna (62). Power cannot be supplied to the detection device (40) if the detection device (40) is away from the power transmission antenna (62) by 5 m or more. It is possible to check whether the reading device (50) is near a specific detection device (40) by checking whether power is supplied.

In the fluid leakage detection system (1) according to the embodiment, the reading device (50) further includes a display (52) and a speaker (53) configured to make a notification that the first information has been received from the detection device (40). The first information is the information indicating that the sensor (41) has detected a leakage of the refrigerant. Specifically, the first information is the capacitance value detected by the sensor (41) and exceeding a predetermined threshold. It is thus possible to know the refrigerant is leaking at a position where a predetermined detection device (40) is provided.

In the fluid leakage detection system (1) according to the embodiment, the reading device (50) further includes a display (52) and a speaker (53) configured to make a notification that the second information has been received from the detection device (40). The second information is the information indicating that the sensor (41) has detected no leakage of the refrigerant. Specifically, the second information is the capacitance value detected by the sensor (41) and within a predetermined threshold range. It is thus possible to know the refrigerant is not leaking at a position where a predetermined detection device (40) is provided.

The fluid leakage detection system (1) according to the embodiment causes the sensor (41) to start the refrigerant leakage detection operation, only when the power supply unit (60) is supplying power to the detection device (40). Accordingly, the power supply and the communication can be performed at the same time.

Variation

A variation of the fluid leakage detection system (1) will be described. When the reading device (50) no longer receives predetermined information from a detection device (40), the speaker (53) according to this example makes a notification that the reading device (50) is not in the vicinity of that detection device (40). The "vicinity" in this example refers to the inside of the communication area of the detection device (40), which will be described later. A configuration different from the fluid leakage detection system (1) according to the above embodiment will be described below.

Figure 10:
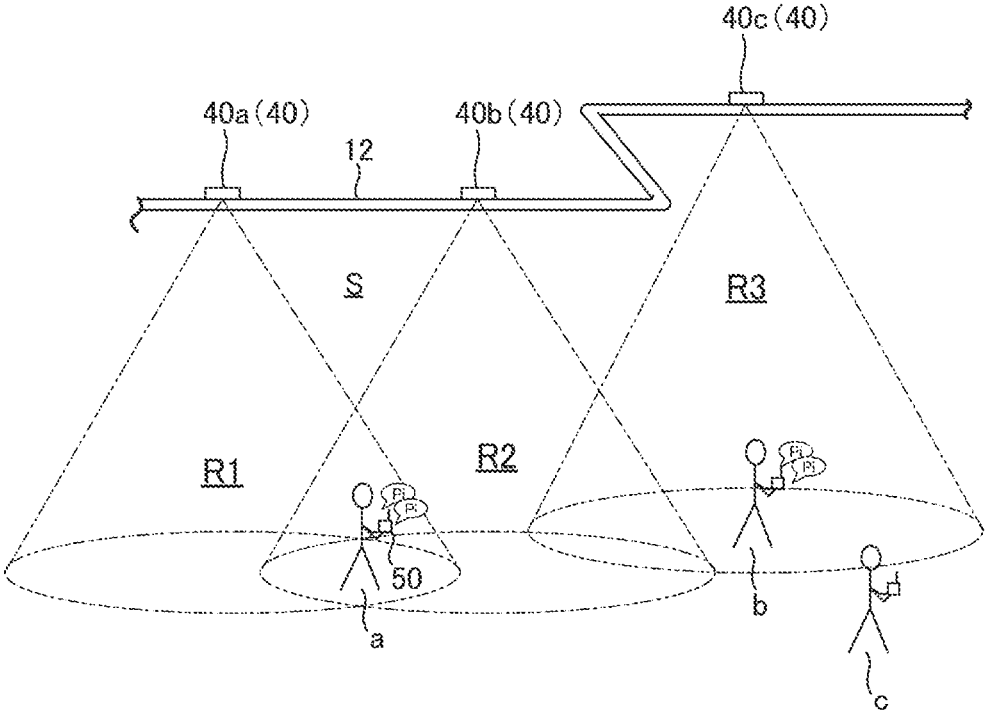
FIG. 10 is a diagram illustrating a method of checking a leakage of a refrigerant from a refrigerant pipe in a fluid leakage detection system according to a variation of the embodiment.

As shown in FIG. 10, the plurality of detection devices (40) are arranged in the refrigerant pipe (12) at predetermined intervals. Specifically, the refrigerant pipe (12) is placed in a space behind the ceiling. The first detection device (40*a*), the second detection device (40*b*), and a third detection device (40*c*) are arranged sequentially along the refrigerant pipe (12). The areas in which the first to third detection devices (40*a*, 40*b*, 40*c*) can communicate with the reading device (50) are referred to as a first communication area (R1), a second communication area (R2), and a third communication area (R3), respectively (the areas surrounded by the dot-dot-dash lines in FIG. 10). The first detection device (40*a*) and the second detection device (40*b*) are arranged such that the first communication area (R1) and the second communication area (R2) partially overlap each other. The second detection device (40*b*) and the third detection device (40*c*) are arranged such that the second communication area (R2) and the third communication area (R3) partially overlap each other. In this figure as well, an operator standing on the floor supplies power to the respective detection devices (40) and communicates with the detection devices (40) with the reading device (50) held in their hand. Alternatively, the reading device (50) may be held close to the ceiling for power supply and communication.

The speaker (53) of the reading device (50) according to this example generates a notification sound indicating that the reading device (50) is communicating with the detection device (40). If the reading device (50) is not communicating with the detection device (40), the speaker (53) stops emitting the notification sound.

Assume that the user moves in the indoor space with the reading device (50) in their hand to communicate with the detection devices (40) sequentially from the first detection device (40*a*) along the refrigerant pipe (12). Since a space between the first detection device (40*a*) and the second detection device (40*b*) is within the communication area, the reading device (50) keeps emitting the communication sound, while the reading device (50) is moving from the first detection device (40*a*) to the second detection device (40*b*) and from the second detection device (40*b*) to the third detection device (40*c*) (location a and location b in FIG. 10) along the refrigerant pipe (12).

On the other hand, assume that after the reading device (50) communicates with the second detection device (40*b*), the reading device (50) moves in a direction away from the third detection device (40*c*) (i.e., in a direction away from the refrigerant pipe (12)). The reading device (50) stops emitting the communication sound when the reading device (50) is out of the first to third communication areas (R1 to R3).

In this manner, the reading device (50) according to this example determines whether the reading device (50) is within the communication area of any one of the plurality of detection devices (40). When the second communicator (204) of the reading device (50) communicates with the first communicator (102) of the detection device (40), the determiner (203) determines that the reading device (50) is within the communication area of the detection device (40). When the second communicator (204) of the reading device (50) cannot communicate with the first communicator (102) of the detection device (40), the determiner (203) determines that the reading device (50) is not within the communication area of the detection device (40).

The result of determination by the determiner (203) is output from the output unit (202) to the speaker (53). If the reading device (50) is within the communication area of the detection device (40), the speaker (53) emits a notification sound indicating that the reading device (50) and the detection device (40) are communicating with each other. If the reading device (50) is not within the communication area of the detection device (40), the speaker (53) stops emitting the notification sound indicating that the reading device (50) and the detection device (40) are communicating with each other.

Figure 11:
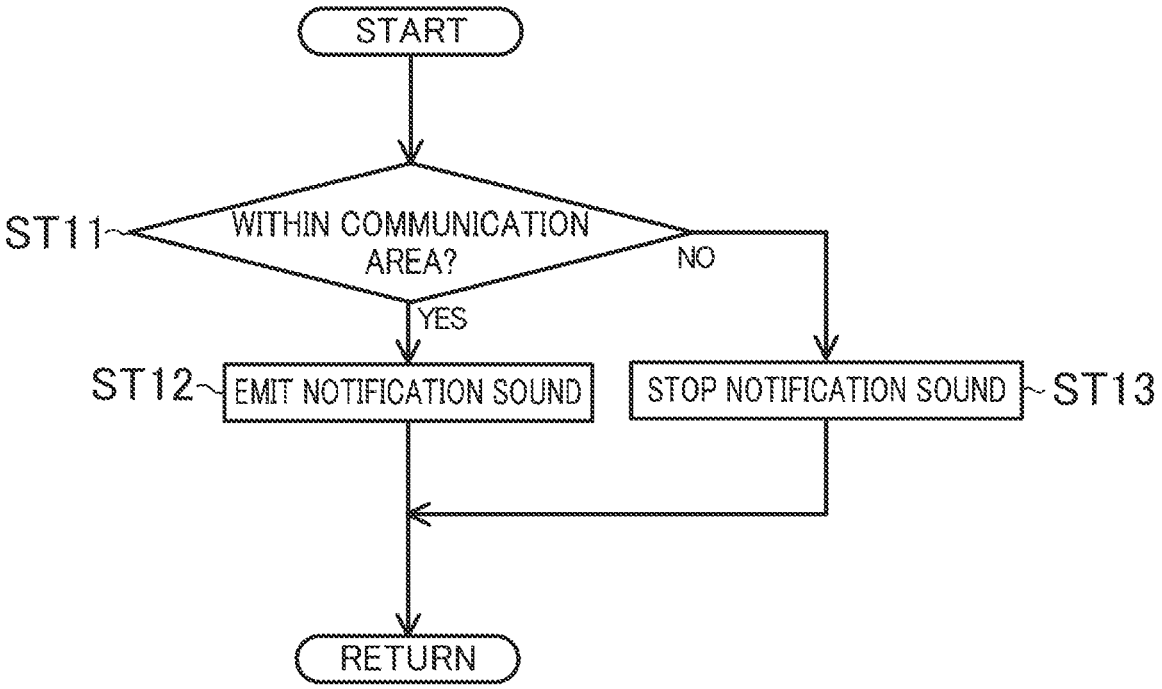
FIG. 11 is a flowchart showing control of communication between a detection device and a reading device in a fluid leakage detection system according to a variation of the embodiment.

The flowchart of the control device (C) according to this example will be described below with reference to FIG. 11.

In Step ST11, the control device (C) determines whether the reading device (50) is located in the communication areas (R1 to R3) of the detection devices (40). If it is determined that the reading device (50) is within the communication area (YES in Step ST11), Step ST12 is executed. If it is determined that the reading device (50) is not within the communication areas (NO in Step ST11), Step ST13 is executed.

In Step ST12, the control device (C) cause the speaker (53) to emit the communication sound.

In Step ST13, the control device (C) cause the speaker (53) to stop emitting the communication sound.

As described above, in the fluid leakage detection system (1) according to this example, the user realizes by the interruption of the communication sound that the user is away from the refrigerant pipe (12) while checking a leakage of the refrigerant sequentially along the refrigerant pipe (12). Accordingly, the user can grasp how the refrigerant pipe (12) is arranged in the space behind the ceiling or behind the wall, while staying in the indoor space (S).

OTHER EMBODIMENTS

The above-described embodiment and variation may be configured as follows.

The fluid leakage detection system (1) may be applied to liquid leakage detection. In this case, the fluid according to the present disclosure is a liquid, such as water. A liquid, such as water, flows through the flow path (12) according to the present disclosure.

Figure 12:
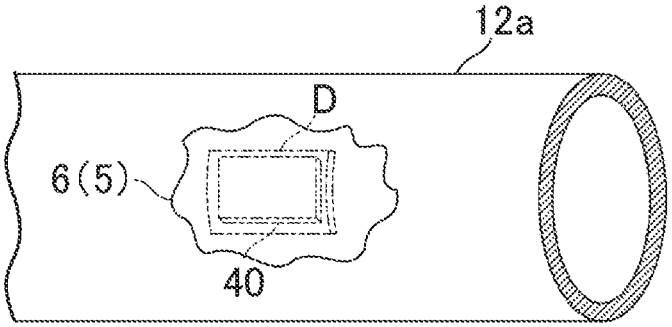
FIG. 12 is a diagram corresponding to FIG. 9B, illustrating attachment of a sealing member of a fluid leakage detection system according to another embodiment to a refrigerant pipe.

As shown in FIG. 12, the sealing member (6) may be provided so as to adhere to part of the outer circumferential surface of the pipe (12*a*) as long as the sealing member (6) covers the entire detection device (40).

The power supply unit (60) is not necessarily provided in the reading device (50). The power supply unit (60) may be a power supply device separate from the reading device (50).

The detection device (40) may include a power receiving antenna which also serves as a communication antenna for transmitting and receiving predetermined information to and from the reading device (50).

The reading device (50) may include a power transmission antenna (62) which also serves as a communication antenna for transmitting and receiving predetermined information to and from the detection device (40).

The detection device (40) may transmit a signal indicating a capacitance value to the reading device (50). In this case, the reading device (50) determines the first information or the second information, based on the received capacitance value.

The detection device (40) may determine whether there is a leakage of the refrigerant, based on a change in the detected capacitance value. In this case, the detection device (40) having detected a leakage of the refrigerant transmits the first information to the reading device (50). The detection device (40) having detected no leakage of the refrigerant transmits the second information to the reading device (50).

The reading device (50) does not necessarily cause the detection device (40) to start the refrigerant leakage detection operation by the sensor (41) during the power supply. In this case, the reading device (50) may start the refrigerant leakage detection operation by the sensor (41) before or after the power supply.

The detection device (40) may perform the detection operation using the sensor (41) without using the control command transmitted from the reading device (50).

The power supply unit (60) may be able to supply power to the detection device (40) even when the distance between the power transmission antenna (62) and the detection device (40) is equal to or more than 5 m.

The directivity of the radio waves transmitted by the power transmission antenna (62) may be controlled by the control device (C).

The sensor (41) is not necessarily a capacitive sensor. The sensor (41) may be a semiconductor gas sensor or any other suitable sensor.

In the variation described above, the reading device (50) may notify the display (52) that the reading device (50) is within the communication area of the detection device (40).

Information indicating the amount of remaining power in the first power storage (43) may be input to the first input unit (101). The reading device (50) can check the amount of remaining power in each detection device (40) through communication with the detection device (40).

While the embodiment and variation thereof have been described above, it will be understood that various changes in form and details may be made without departing from the spirit and scope of the claims. The foregoing embodiment and variation thereof may be combined and replaced with each other without deteriorating the intended functions of the present disclosure. The expressions of "first," "second," . . . described above are used to distinguish the terms to which these expressions are given, and do not limit the number and order of the terms.

As described above, the present disclosure is useful for a fluid leakage detection system.

The invention claimed is:

1. A fluid leakage detection system comprising:

a detection device including a sensor and a first electronic controller configured to detect a leakage of a fluid from a flow path;

a communication device including a communicator configured to transmit and receive, to and from the detection device, predetermined information as to whether there is a leakage of the fluid; and a power supply unit configured to supply power to the detection device in a wireless manner, the flow path including a pipe, and an outer layer that covers an outer circumferential surface of the pipe, the detection device being arranged between the pipe and the outer layer.

2. The fluid leakage detection system of claim 1, further comprising:

a sealing structure configured to seal the sensor from outside air in a state in which the detection device is attached to the flow path.

3. The fluid leakage detection system of claim 2, wherein the sealing structure includes a sealing member that comes into contact with the outer circumferential surface of the pipe of the flow path so as to cover the detection device.

4. The fluid leakage detection system of claim 1, wherein the pipe is a refrigerant pipe through which a refrigerant flows, and the fluid is a fluid mixture containing the refrigerant.

5. The fluid leakage detection system of claim 1, wherein the detection device includes a first detection device and a second detection device, and the first detection device and the second detection device are arranged at different points in the flow path.

6. The fluid leakage detection system of claim 5, wherein the power supply unit is provided in the communication device, and the communication device includes a power transmission antenna configured to transmit a power supply radio wave to the detection device.

7. The fluid leakage detection system of claim 6, wherein the power transmission antenna transmits the power supply radio wave with directivity controlled so that an intensity of power to be received by the first detection device is higher than an intensity of power to be received by the second detection device.

8. The fluid leakage detection system of claim 6, wherein the detection device receives the power within a distance of 5 meters from the power transmission antenna.

9. The fluid leakage detection system of claim 1, further comprising:

a display or speaker configured to make a notification that the communication device is not in vicinity of the detection device when the communication device no longer receives the predetermined information from the detection device.

10. The fluid leakage detection system of claim 1, wherein the predetermined information is first information indicating that the sensor has detected a leakage of the fluid, and the communication device further includes an annunciator configured to make a notification that the first information has been received from the detection device.

11. The fluid leakage detection system of claim 1, wherein the predetermined information is second information indicating that the detector sensor has detected no leakage of the fluid, and the communication device further includes an annunciator configured to make a notification that the second information has been received from the detection device.

12. The fluid leakage detection system of claim 1, wherein the fluid leakage detection system causes the sensor to start a fluid leakage detection operation, only when the power supply unit is supplying the power to the detection device.

13. The fluid leakage detection system of claim 1, wherein the sensor is a capacitive sensor.

14. A fluid leakage detection system comprising:

a detection device including a sensor configured to detect a leakage of a fluid from a flow path;

a communication device including a communicator configured to transmit and receive, to and from the detection device, predetermined information as to whether there is a leakage of the fluid, the communication device including a power transmission antenna configured to transmit a power supply radio wave to the detection device; and a power supply unit configured to supply power to the detection device in a wireless manner, the power supply unit being provided in the communication device, the detection device including a first detection device and a second detection device, the first detection device and the second detection device being arranged at different points in the flow path, and the power transmission antenna transmitting the power supply radio wave with directivity controlled so that an intensity of power to be received by the first detection device is higher than an intensity of power to be received by the second detection device.

* * * * *